US005213318A

United States Patent [19]

Newhall

[11] Patent Number: 5,213,318

[45] Date of Patent: May 25, 1993

[54] SIGNATURE GATHERER WITH LIGHT DETECTOR MISFEED SENSORS

[75] Inventor: Thomas O. Newhall, Burnt Hills, N.Y.

[73] Assignee: AM International Incorporated, Chicago, Ill.

[21] Appl. No.: 816,746

[22] Filed: Jan. 2, 1992

[51] Int. Cl.[5] ..... B65H 5/30; B65H 39/02

[52] U.S. Cl. ..... 270/55; 270/54; 270/58

[58] Field of Search ..... 270/54, 55, 56, 58

[56] References Cited

U.S. PATENT DOCUMENTS

| | | | |
|---|---|---|---|
| 1,039,541 | 9/1912 | Kast | 270/56 |
| 2,892,627 | 6/1959 | Newhouse | 270/55 |
| 3,519,264 | 7/1970 | Beacham et al. | 270/58 |
| 3,561,752 | 2/1971 | McCain et al. | 270/54 X |
| 3,825,247 | 7/1974 | Fernandez-Rana et al. | 270/58 |
| 3,953,018 | 4/1976 | Maopolski | 270/55 |
| 4,046,367 | 9/1977 | Merker et al. | 270/55 |
| 4,078,784 | 3/1978 | Miaskoff et al. | 270/56 |
| 4,923,189 | 5/1990 | Nail | 270/54 |
| 4,988,086 | 1/1991 | Schlough | 270/55 |
| 5,154,404 | 10/1992 | Orsinger et al. | 270/54 X |

*Primary Examiner*—Edward K. Look
*Assistant Examiner*—John Ryznic
*Attorney, Agent, or Firm*—Tarolli, Sundheim & Covell

[57] ABSTRACT

An apparatus calipers a signature delivered from a hopper into a collating pocket movable past the hopper. The apparatus comprises a light source and a member supported on the pocket and movable with the pocket relative to the hopper and movable past the light source to interrupt light from the light source. The member moves past the light source to interrupt the light from the light source when a signature is delivered from the hopper into the pocket. A sensor senses non-interrupted light from the light source when the member moves past the light source. The amount of non-interrupted light from the light source is outside of a predetermined range when a misfeed occurs from the hopper into the pocket. Preferably, the member includes a shaft supported on the pocket for rotation about the longitudinal central axis of the shaft and a plate connected to one end of the shaft. The shaft rotates about its longitudinal central axis when a signature is delivered from the hopper into the pocket. The plate moves past the light source to interrupt the light from the light source when the shaft rotates about its longitudinal central axis.

24 Claims, 4 Drawing Sheets

1444sh4

SIGNATURE GATHERER WITH LIGHT DETECTOR MISFEED SENSORS

BACKGROUND OF THE INVENTION

TECHNICAL FIELD

The present invention relates to an apparatus for collating sheet material, and is particularly directed to an apparatus for calipering sheet material delivered from a hopper of a collator into a movable pocket of the collator.

BACKGROUND ART

A known collator includes a stationary hopper and a transfer drum associated with the hopper. The transfer drum feeds a signature from a stack of sheet material in the hopper and transfers the signature to a collating conveyor passing the hopper. A calipering device is associated with the transfer drum of the hopper.

Typically, the calipering device includes an idler roller mounted to a pivotable lever arm. A spring acts on the lever arm to spring-load the idler roller against the transfer drum. When the hopper transfers a signature to the collating conveyor, the idler roller is displaced an amount within a predetermined range.

If a misfeed condition such as a multiple feed occurs, the idler roller is displaced an amount outside of the predetermined range. When the idler roller is displaced an amount outside of the predetermined range, a sensing mechanism indicates the multiple feed condition. If a misfeed condition such as a miss occurs, the idler roller remains stationary and is not displaced at all. When the idler roller is not displaced, a sensing mechanism indicates the miss condition. Other sensors for use in devices for handling sheet material are disclosed in U.S. Pat. No. 3,902,716 and U.S. Pat. No. 4,864,124.

Another known collator is disclosed in U.S. Pat. No. 4,988,086. The collator of U.S. Pat. No. 4,988,086 includes a plurality of hoppers for holding stacks of sheet material and a plurality of pockets movable past the stacks of sheet material in turn. A plurality of feeding mechanisms feeds sheet material from the stacks of sheet material to the pockets. Each of the feeding mechanisms is operable to feed sheet material from each stack of the plurality of stacks of sheet material and is movable past each of the stacks of sheet material in turn. The collator of U.S. Pat. No. 4,988,086 does not include a device for calipering sheet material fed from the stacks of sheet material to the pockets.

SUMMARY OF THE INVENTION

The present invention is directed to an apparatus for collating sheet material. The apparatus includes a plurality of hoppers for holding signatures. A collating space or pocket is movable past the plurality of hoppers and is provided for receiving a signature from each of the plurality of hoppers in turn.

A detector is provided to detect the occurrence of a misfeed at the pocket. The detector includes a movable member which has a different orientation relative to the pocket when a misfeed occurs than when a normal feed occurs. A sensor is provided to sense the orientation of the member.

The member includes a plate which is movable with the pocket relative to the hoppers and is movable past a light source to block light from the light source. The plate is in an initial position when no signature is being fed from a hopper into the pocket. When a normal feed occurs, a signature is delivered from a hopper into the pocket and the plate moves past the light source. The plate moves relative to the pocket from the initial position to a position to block a first amount of light from the light source when a normal feed occurs. The plate moves relative to the pocket from the initial position to a different position to block a second amount of light from the light source when a misfeed occurs.

When a normal feed occurs, the amount of light from the light source not blocked by the plate is within a predetermined range. When a misfeed occurs, the amount of light from the light source not blocked by the plate is outside of the predetermined range. A sensor senses the amount of light from the light source not blocked by the plate as the plate moves past the light source.

The plate may be connected to one end of a shaft supported on the pocket for rotation about the longitudinal central axis of the shaft. In this embodiment of the invention, a displaceable roller cooperates with a driven roller to form a nip. When a signature is delivered from a hopper, the signature passes through the nip into the pocket. When the signature passes through the nip, the displaceable roller moves away from a neutral position. Thus, the displaceable roller moves away from its neutral position when a signature is delivered from the hopper through the nip into the pocket.

The shaft rotates about its longitudinal central axis when the displaceable roller moves away from its neutral position. The extent of rotation of the shaft about its longitudinal central axis varies as a function of the extent of movement of the displaceable roller away from its neutral position. The plate is in its initial position when the displaceable roller is in its neutral position. The plate moves past the light source and moves from its initial position to a different position to block a different amount of light when the shaft rotates about its longitudinal central axis in response to movement of the displaceable roller away from its neutral position. Accordingly, the sensor senses a different amount of light from the light source not blocked by the plate when the plate moves from its initial position to another position to block a different amount of light from the light source.

In another embodiment of the invention, the plate remains stationary relative to the pocket in response to a misfeed into the pocket. The plate remains stationary relative to the pocket and blocks a different amount of light from the light source when a misfeed occurs than when a normal feed occurs. A sensor senses the amount of the light from the light source not blocked by the plate. Accordingly, the sensor senses a different amount of light from the light source not blocked by the plate when the plate remains stationary relative to the pocket to block a different amount of light from the light source.

BRIEF DESCRIPTION OF THE DRAWINGS

The foregoing and other features of the present invention will become apparent to one skilled in the art upon a consideration of the following description of the invention with reference to the accompanying drawings, wherein.

DESCRIPTION OF A PREFERRED EMBODIMENT

Figure 1:
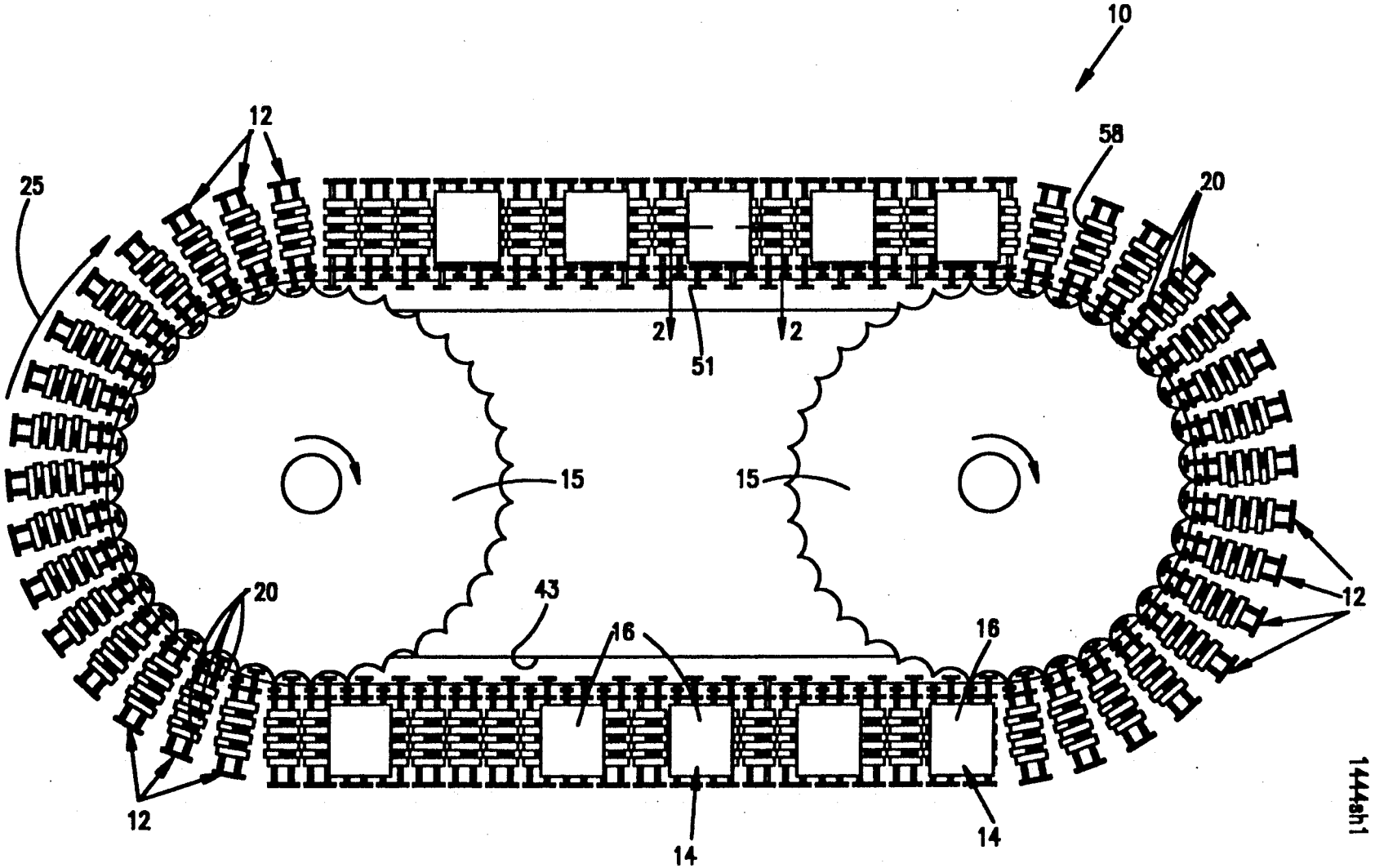
FIG. 1 is a schematic plan view of a collator embodying the present invention.

The present invention is directed to an apparatus for collating sheet material. The specific construction and use of the present invention may vary. By way of example, the present invention is illustrated in FIG. 1 as embodied in a collator 10 for forming sheet material assemblages.

The collator 10 includes a plurality of sheet material assemblers 12 linked together and movable along a continuous path under stationary bottomless hoppers 14. The sheet material assemblers 12 are interconnected with a chain (not shown) wrapped around a pair of drive sprockets 15. The sheet material assemblers 12 are moved by the pair of drive sprockets 15 which are rotated at a constant speed. A plurality of stacks 16 of sheet material are disposed in the bottomless hoppers 14.

Each of the bottomless hoppers 14 has fingers 45 (shown in FIG. 2) to separate layers of sheet material as it is being fed. The fingers 45 of each of the bottomless hoppers 14 also partially support one edge portion of the sheet material remaining in the particular hopper as a lower sheet material layer is fed from the hopper. As the sheet material assemblers 12 move beneath each of the stationary bottomless hoppers 14 in turn, sheet material from the plurality of stacks 16 of sheet material is fed to the sheet material assemblers 12 to form sheet material assemblages.

Figure 2:
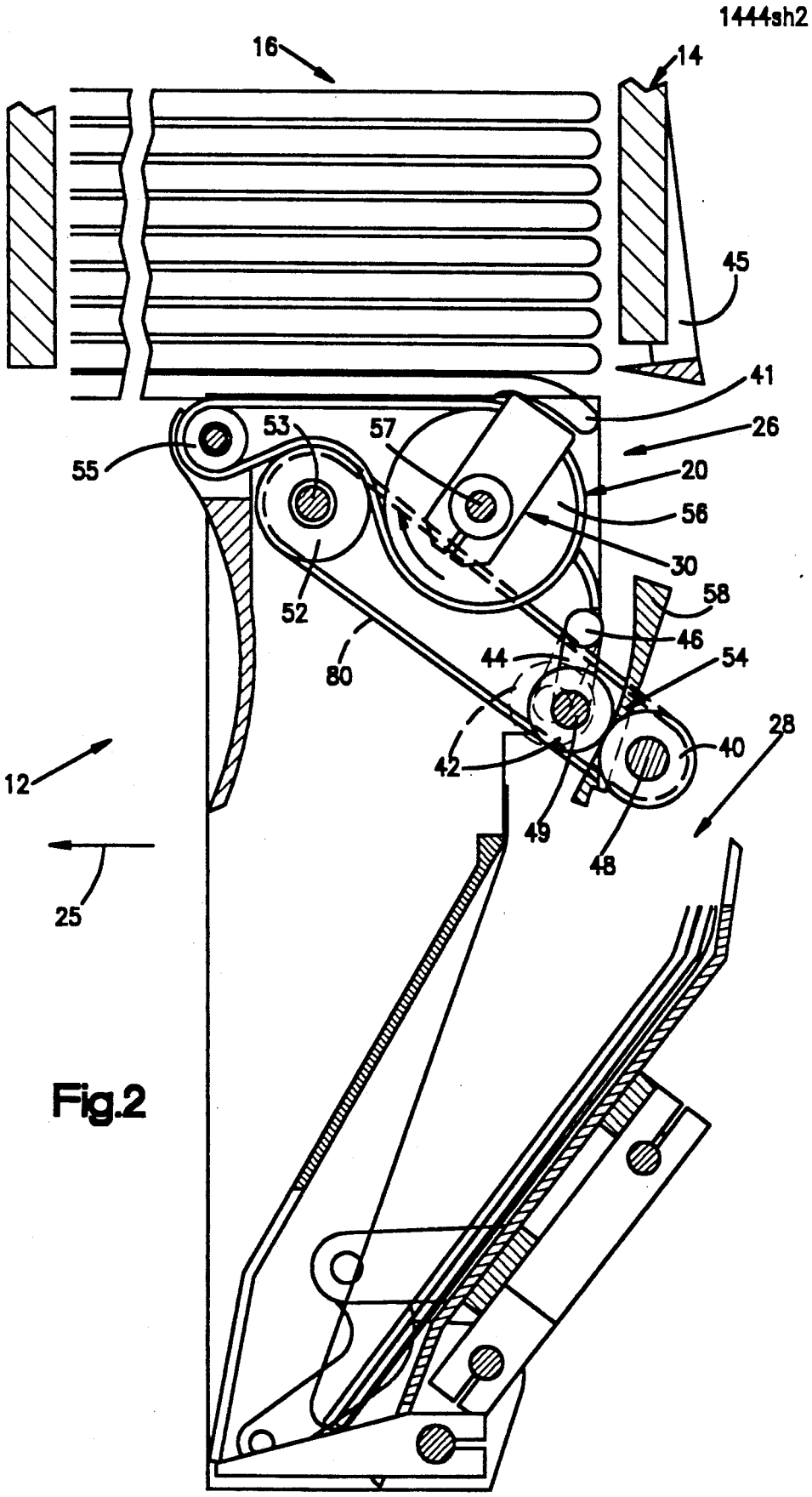
FIG. 2 is a sectional view, taken generally along the line 2—2 of FIG. 1, illustrating the relationship of a collating space or pocket to a hopper holding signatures.

Referring to FIGS. 1 and 2, the sheet material assemblers 12 all have the same construction. Each of the sheet material assemblers 12 includes belts 20 which support the stacks 16 of sheet material disposed in the bottomless hoppers 14. As shown in FIG. 2, each of the sheet material assemblers 12 includes a feed mechanism 26 and a pocket 28. Each feed mechanism 26 includes vacuum grippers 30 which grip a lowermost sheet in one of the stacks 16 of sheet material. The grippers 30 initiate downward movement of a gripped sheet of material to the pocket 28. The feed mechanism 26 is operable to feed sheet material from each of the stacks 16 of sheet material in turn to the pocket 28. The pocket 28 moves in the direction of an arrow 25 relative to a stationary frame 43 (shown in FIG. 1) of the collator 10.

Each of the sheet material assemblers 12 is associated with a drive roller 51 (shown in FIG. 1) which continuously rolls along the stationary frame 43 of the collator 10. A belt drive roller 52 (shown in FIG. 2) is associated with the drive roller 51. The belt drive roller 52 has the same diameter as the drive roller 51. A shaft 53 is operatively connected between the drive roller 51 and the belt drive roller 52. When the drive roller 51 continuously rolls along the stationary frame 43, the drive roller 51 drives the belt drive roller 52 through the shaft 53. The belt drive roller 52, in turn, continuously drives the belts 20 of the associated one of the assemblers 12. The belt drive roller 52 continuously drives the belts 20 at the same speed as which the assemblers 12 move relative to the stationary bottomless hoppers 14.

Each of the belts 20 extends around a pair of idler rollers 55, 56, as shown in FIG. 2. The pair of idler rollers 55, 56 support each of the belts 20 for movement under influence of the drive roller 52. The drive roller 52 drives a drive belt 80 which, in turn, drives a roller (not shown) disposed at one end of a horizontal drive shaft 48. A driven roller 40 is secured to a central portion of the drive shaft 48. The drive roller 52 rotates about its longitudinal central axis to move the drive belt 80 so as to rotate the driven roller 40 about its longitudinal central axis.

A shaft 57 supports the idler roller 56 for rotation about its longitudinal central axis. The grippers 30 are rotatable with the shaft 57 and the idler roller 56. When the grippers 30 rotate with the shaft 57 and the idler roller 56, the downstream end portion of the lowermost sheet material layer on the one of the stacks 16 of sheet material is pulled downwardly. As shown in FIG. 2, the lowermost sheet material layer is designated with the reference numeral 41. The sheet material layer 41 continues to move downwardly through a space defined between belts 20 on adjacent sheet material assemblers 12.

As the grippers 30 continue to rotate, the downstream end portion of the sheet material layer 41 moves into engagement with a stripper plate 58. When this occurs, the vacuum to the grippers 30 is interrupted and the grippers 30 release the sheet material layer 41. The grippers 30 continue to rotate until they reach an initial position. When the grippers 30 reach the initial position, rotation of the grippers 30 is interrupted until a sheet material layer in a next succeeding one of the stacks 16 of sheet material is to be fed. The sheet material assemblers 12 and the bottomless hoppers 14 are constructed and cooperate with each other to form sheet material assemblages in the pocket 28 in the same manner as is disclosed in U.S. Pat. No. 4,988,086, issued Jan. 29, 1991 and entitled "Apparatus and Method for Forming Sheet Material Assemblages".

Figure 3:
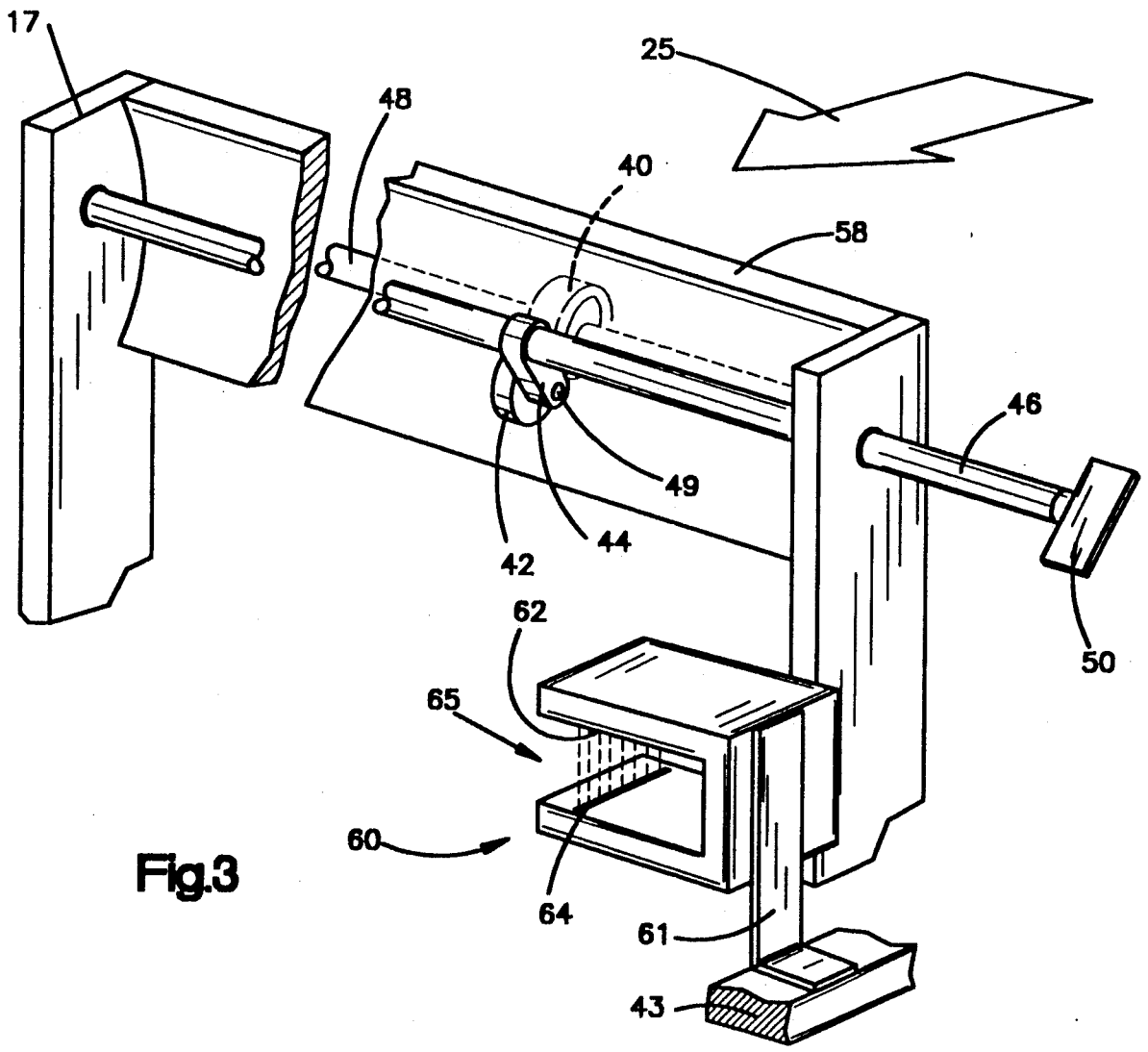
FIG. 3 is a schematic perspective view illustrating the construction of a misfeed detector assembly used in the collator of FIG. 1.

Referring to FIGS. 2 and 3, the driven roller 40 is rotatably supported on a frame part 17 of the associated one of the assemblers 12. A floating roller 42 is fixedly connected with one end of a linkage 44 by a pin 49. The other end of the linkage 44 is mechanically coupled to a horizontal shaft 46. The shaft 46 is supported by the frame part 17 for rotation about its longitudinal central axis. The driven roller 40 extends through an opening in the stripper plate 58 to engage the floating roller 42 and form a nip 54 therebetween.

As shown in FIG. 2, the floating roller 42 is displaceable from a first position (shown in solid lines) to a second position (shown in dotted lines). The floating roller 42 is in the first position when there is no sheet material layer located in the nip 54. The first position of the floating roller 42 as shown in solid lines in FIG. 2 corresponds to a neutral position of the floating roller 42. The floating roller 42 moves away from the neutral position to a position such as the second position shown in dotted lines in FIG. 2 when a sheet material layer moves into the nip 54.

A plate 50 is connected to one end of the shaft 46. The plate 50 is in an initial position relative to the frame part 17 when the floating roller 42 is in its neutral position as shown in solid lines in FIG. 2. The orientation of the plate 50 relative to the frame part 17 changes in response to rotation of the shaft 46 about its longitudinal central axis. The change in orientation of the plate 50 depends upon the change in position of the shaft 46 about its longitudinal central axis. The change in position of the shaft 46 about its longitudinal central axis depends upon the change in position of the floating roller 42. Thus, the change in orientation of the plate 50 depends upon the change in position of the floating roller 42.

Figure 8:
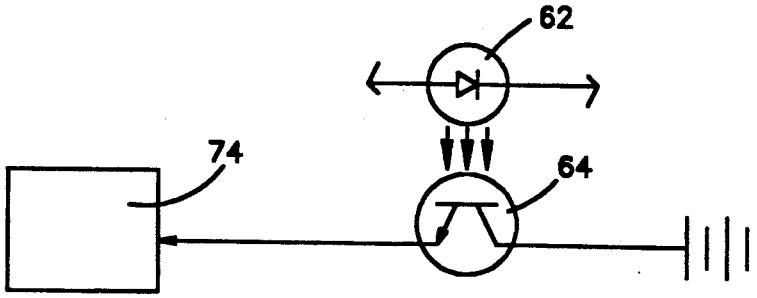
FIG. 8 is a schematic diagram illustrating a light source and a light sensor in a detector.

Referring to FIG. 3, a sensing unit 60 is mounted on a bracket 61 fixedly connected to the frame 43 of the collator 10. The sensing unit 60 includes a light source 62 and a light sensor 64 (FIG. 8) located opposite the light source 62. A gap 65 (FIG. 3) is defined between the light source 62 and the light sensor 64. The gap 65 is large enough to accommodate movement of the plate 50 into the gap 65. The plate 50 moves into the gap 65 to block a portion of the light from the light source 62 when a sheet material layer moves into the nip 54 defined between the floating roller 42 and the driven roller 40. The amount of light from the light source 62 not blocked by the plate 50 depends upon the orientation of the plate 50 relative to the frame part 17 when the plate 50 is in the gap 65. The light sensor 64 senses the amount of light from the light source 62 not blocked by the plate 50.

Figure 4:
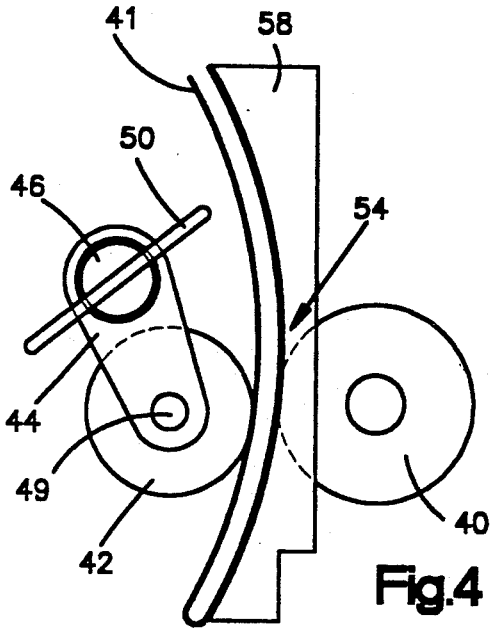
FIG. 4 is a schematic view of a portion of the detector assembly of FIG. 3 and illustrating sheet material being fed between a pair of rollers during a normal feed condition.
Figure 5:
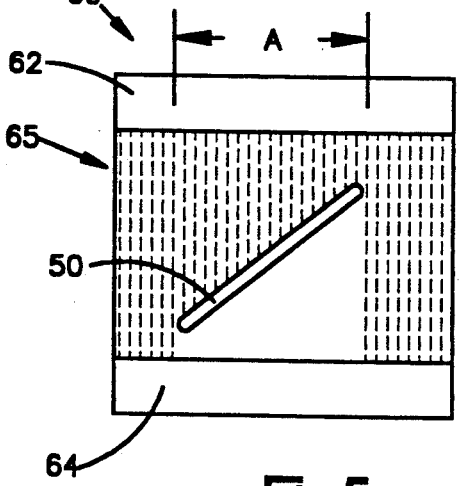
FIG. 5 is a schematic view of a portion of the detector assembly of FIG. 3 and illustrating the position of a plate relative to a detector during a normal feed condition.

Referring to FIGS. 4 and 5, the single sheet material layer 41 is shown located in the nip 54 between the driven roller 40 and the floating roller 42. As shown in FIG. 4, the floating roller 42 is displaced a predetermined amount from its neutral position. The shaft 46 is rotated about its longitudinal central axis a predetermined amount corresponding to the predetermined amount of displacement of the floating roller 42 from its neutral position. The plate 50 shown in FIG. 4, in turn, is displaced from its initial position an amount corresponding to the predetermined amount of rotation of the shaft 46 about its longitudinal central axis. Thus, the predetermined amount of displacement of the plate 50 shown in FIGS. 4 and 5 from its initial position corresponds to the predetermined amount of displacement of the floating roller 42 shown in FIG. 4 from its neutral position.

When the plate 50 is in the position as shown in FIGS. 4 and 5, an amount of light corresponding to the horizontal projection A of the plate 50 is blocked. The amount of light not blocked by the plate 50 is outside of the horizontal projection A of the plate 50. The light sensor 64 senses the amount of light not blocked by the horizontal projection A of the plate 50 during feeding of the single sheet material layer 41 into the nip 54. Thus, the amount of light not blocked by the horizontal projection A of the plate 50 is indicative of a normal feed condition, i.e., the feeding of the single sheet material layer 41 into the nip 54.

Figure 6:
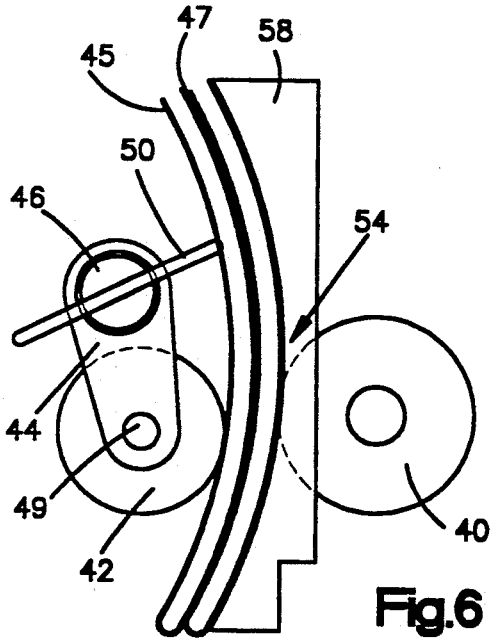
FIG. 6 is a schematic view, similar to FIG. 4, illustrating sheet material being fed between the pair of rollers during a misfeed condition.
Figure 7:
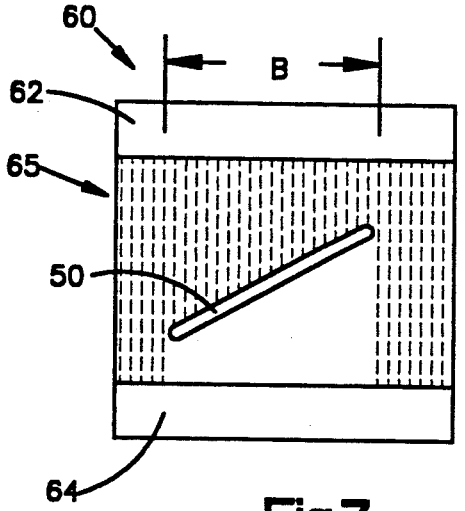
FIG. 7 is a schematic view, similar to FIG. 5, illustrating the position of the plate relative to the detector during the misfeed condition of FIG. 6.

Referring to FIGS. 6 and 7, two sheet material layers 45, 47 are shown located in the nip 54 between the driven roller 40 and the floating roller 42. When the two sheet material layers 45, 47 are in the nip 54 as shown in FIG. 6, the floating roller 42 is displaced an amount more than the predetermined amount of displacement shown in FIG. 4. Accordingly, the shaft 46 shown in FIG. 6 is rotated about its longitudinal central axis an amount more than the amount shown in FIG. 4 and the plate 50 shown in FIG. 7 is displaced more than the predetermined amount shown in FIG. 5.

When the plate 50 is in the position as shown in FIG. 7 an amount of light corresponding to the horizontal projection B of the plate 50 is blocked. The light outside of the horizontal projection is not blocked. The amount of light not blocked by the horizontal projection B shown in FIG. 7 is less than the amount of light not blocked by the horizontal projection A shown in FIG. 5. The light sensor 64 senses the amount of light not blocked by the horizontal projection B of the plate 50 during feeding of the two sheet material layers 45, 47 into the nip 54. Thus, the amount of light not blocked by the horizontal projection B of the plate 50 is indicative of a multiple feed condition, i.e., the feeding of the two sheet material layers 45, 47 into the nip 54.

It should be apparent that the apparatus described hereinabove calipers sheet material layers delivered from the hoppers 14 to the pocket 28 and provides a signal indicative of a multiple feed condition, i.e., more than one sheet material layer being fed. It should also be apparent that the apparatus described hereinabove is able to provide a signal indicative of a miss condition, i.e., the absence of a sheet material layer being fed when a sheet material layer should be fed. In the absence of a sheet material layer being fed when a sheet material layer should be fed, the plate 50 remains in its initial position and the amount of light not blocked by the horizontal projection (not shown) of the plate 50 is more than the amount of light not blocked by the horizontal projection A shown in FIG. 5. The light sensor 64 senses the amount of light not blocked by the horizontal projection of the plate 50 in its initial position. The amount of light not blocked by the horizontal projection of the plate 50 when the plate 50 remains in its initial position is indicative of the absence of a sheet material layer in the nip 54 when a sheet material layer should be in the nip 54.

The light source 62 (shown in FIG. 8) is a light emitting diode and the light sensor 64 is a phototransistor. When light from the light source 62 strikes the light sensor 64, an output signal is transmitted to a controller 74. The magnitude of the signal transmitted to the controller 74 varies as a function of the amount of light transmitted to the light sensor 64. When the magnitude of the signal transmitted from the light sensor 64 to the controller 74 indicates that a misfeed occurred, the controller 74 initiates suitable action to compensate for the misfeed condition.

From the above description of the invention, those skilled in the art will perceive improvements, changes and modifications. Such improvements, changes and modifications within the skill of the art are intended to be covered by the appended claims.

Having described the invention, the following is claimed:

1. An apparatus for forming sheet material assemblages, said apparatus comprising a plurality of hoppers for holding sheet material, a plurality of receiving locations, means for sequentially moving each of said receiving locations past each of said hoppers in turn, a plurality of feeder means for performing sheet feeding operations to feed sheet material from said hoppers to said receiving locations, and a plurality of detector means for detecting the occurrence of a misfeed from said hoppers to said receiving locations during a sheet feeding operation, each of said detector means including a light source, sensor means for sensing light transmitted from said light source, and control means for at least partially blocking the transmission of light from said light source to said sensor means to a first extent to enable a first amount of light to be transmitted from said light source to said sensor means during a normal sheet feeding operation by said feeder means and for at least partially blocking the transmission of light from said light source to said sensor means to a second extent to enable a second amount of light to be transmitted from said light source to said sensor means during a sheet feeding operation in which a misfeed occurs.

2. An apparatus as set forth in claim 1 wherein said control means includes a member having a first orientation relative to said light source during a normal sheet feeding operation and a second orientation relative to said light source during a sheet feeding operation in which a misfeed occurs, said member being effective to block the transmission of a first amount of light from said light source to said sensor means when said member is in the first orientation and being effective to block the transmission of a second amount of light from said light source to said sensor means when said member is in the second orientation.

3. An apparatus as set forth in claim 1 wherein said control means of each of said detector means is connected with one of said receiving locations for movement therewith relative to said hoppers.

4. An apparatus for detecting a misfeed from a hopper to a collating pocket movable past the hopper, said apparatus comprising:

a light source;

a member connected with the pocket and movable with the pocket relative to the hopper and movable past said light source to interrupt light from said light source, said member moving past said light source to interrupt the light from said light source when a signature is delivered from the hopper into the pocket;

sensor means for sensing non-interrupted light from said light source when said member moves past said light source, the amount of non-interrupted light from said light source being outside of a predetermined range when a misfeed occurs from the hopper into the pocket.

5. An apparatus as set forth in claim 4 wherein said member includes a shaft supported on said pocket for rotation about the longitudinal central axis of said shaft and a plate connected to one end of said shaft, said shaft rotating about its longitudinal central axis when a signature is delivered from the hopper into the pocket, said plate moving past said light source to interrupt the light from said light source when said shaft rotates about its longitudinal central axis.

6. An apparatus as set forth in claim 4 further includes a driven roller and a displaceable roller lying against said driven roller to form a nip therebetween for receiving a signature, said displaceable roller being displaced when a signature is delivered from the hopper into the pocket.

7. An apparatus as set forth in claim 6 wherein said member includes a shaft supported on said pocket for rotation about the longitudinal central axis of said shaft and a plate connected to one end of said shaft, said displaceable roller moving away from a neutral position when sheet material is fed from the hopper through the nip into the pocket, said shaft rotating about its longitudinal central axis when said displaceable roller moves away from the neutral position, the extent of movement of said shaft about its longitudinal central axis varying as a function of the extent of movement of said displaceable roller away from the neutral position, said plate moving to a position to block a different amount of light when said shaft rotates about its longitudinal central axis.

8. An apparatus comprising:

a plurality of hoppers for holding signatures;

a collating pocket movable past said plurality of hoppers and for receiving signatures from said plurality of hoppers;

a member connected with said pocket for movement therewith past said plurality of hoppers;

means for supporting said member for movement relative to said pocket to a sensor actuating position in response to a misfeed of plural signatures into said pocket; and sensor means stationary relative to said plurality of hoppers and for sensing that said member has moved to said sensor actuating position, said member being movable with said pocket past said sensor means to enable said sensor means to sense that said member moved to said sensor actuating position in response to a misfeed of plural signatures into said pocket.

9. An apparatus as set forth in claim 8 wherein said member includes a plate supported for movement relative to said pocket, said plate moving to said sensor actuating position in response to a misfeed of plural signature into said pocket.

10. An apparatus as set forth in claim 8 wherein said member includes a shaft connected with said pocket and rotatable about the longitudinal central axis of said shaft and a plate connected to one end of said shaft, said shaft rotating about its longitudinal central axis in response to a misfeed of plural signatures into said pocket, the extend of movement of said plate being associated with the extent of rotation of said shaft about its longitudinal central axis.

11. An apparatus as set forth in claim 8 wherein said member remains stationary relative to said pocket in response to no feed of a signature into said pocket, said sensor means sensing that said member remained stationary relative to said pocket in response to no feed of a signature into said pocket.

12. An apparatus as set forth in claim 11 wherein said member includes a plate connected with said pocket for movement relative to said pocket, said plate remaining stationary relative to said pocket in response to no feed of a signature into said pocket.

13. An apparatus as set foth in claim 11 wherein said member includes a shaft connected with said pocket and rotatable about the longitudinal central axis of said shaft and a plate connected to one end of said shaft, the extent of movement of said plate being associated with the extent of rotation of said shaft about its longitudinal central axis, said shaft remaining stationary relative to said pocket when no feed of a signature into said pocket occurs.

14. An apparatus comprising:

a plurality of hoppers for holding signatures;

a collating pocket movable past said plurality of hoppers and for receiving a signature from each of said plurality of hoppers;

a member connected with said pocket for movement therewith past said plurality of hoppers and for moving a predetermined amount relative to said pocket in response to a misfeed into said pocket, said member including a driven roller and a displaceable roller lying against said driven roller to form a nip therebetween for receiving a signature, said displaceable roller being displaced said predetermined amount in response to a misfeed into said nip; and means for sensing that said member has moved said predetermined amount.

15. An aparatus as set forth in claim 14 wherein said member further includes a shaft supported on said pocket for rotation about the longitudinal central axis of said shaft and a plate connected to one end of said shaft, said shaft rotating about its longitudinal central axis in response to displacement of said displaceable roller, the extent of movement of said plate being associated with the extent of rotation of said shaft about its longitudinal central axis.

16. An apparatus comprising:

a plurality of hoppers for holding signatures;

a collating pocket movable past said plurality of hoppers and for receiving a signature from each of said plurality of hoppers;

a member connected with said collating pocket and for moving relative to said pocket in response to a feed of a signature into said pocket, said member remaining stationary relative to said pocket in response to a misfeed into said pocket, said member including a driven roller and a displaceable roller lying against said driven roller to form a nip therebetween for receiving a signature, said displaceable roller remaining stationary relative to said pocket when a misfeed into said nip occurs; and sensor means for sensing that said member remained stationary in response to a misfeed into said pocket and for providing a signal indicative thereof.

17. An apparatus as set forth in claim 16 wherein said member further includes a shaft supported on said pocket for rotation about the longitudinal central axis of said shaft and a plate connected to one end of said shaft, said shaft rotating about its longitudinal central axis in response to displacement of said displaceable roller, the extent of movement of said plate being associated with the extent of rotation of said shaft about its longitudinal central axis.

18. An apparatus for forming sheet material assemblages, said apparatus comprising holder means for holding a plurality of stacks of sheet material, a plurality of receiving locations movable past each of the stacks of sheet material in turn, a plurality of feeder means movable with said plurality of receiving locations and for feeding sheet material from the stacks of sheet material to said receiving locations, each of said receiving locations being associated with a corresponding one of said feeder means, each of said feeder means being operatable to feed sheet material from each stack of the plurality of stacks of sheet material to its associated receiving location, means for sequentially moving each of said receiving locations and its associated feeder means past each of the stacks of sheet material in turn, a plurality of members located within said receiving locations, each receiving location being associated with a respective one of said members, each member moving an amount within an associated predetermined range in response to feeding of sheet material from the stacks of sheet material to its associated receiving location, and sensor means for sensing the amount of movement of each of said members, said sensor means being stationary relative to said holder means, each member being movable with its associated receiving location past said sensor means to enable said sensor means to sense the amount of movement of the member within its associated predetermined range in response to feeding of sheet material from the stacks of sheet material to its associated receiving location.

19. An apparatus as set forth in claim 18 wherein each member remains stationary relative to its associated receiving location in response to no feed of sheet material from the stacks of sheet material to its associated receiving location.

20. An apparatus as set forth in claim 18 wherein each member moves an amount outside of its associated predetermined range in response to misfeeding of sheet material to its associated receiving location.

21. An apparatus comprising:

a plurality of hoppers for holding signatures;

a collating pocket movable past said plurality of hoppers and for receiving a signature from each of said plurality of hoppers;

a member connected with said pocket for movement therewith past said plurality of hoppers and for moving a predetermined amount relative to said pocket in response to a misfeed into said pocket, said member including a plate supported for movement relative to said pocket, said plate moving said predetermined amount in response to a misfeed into said pocket;

means for sensing that said member has moved said predetermined amount; and a light source for providing a light beam, said plate moving to block a first portion of the light bean when a signature is received in said pocket, said plate moving said predetermined amount to block a second portion of the light beam when a misfeed into said pocket occurs, said sensor means sensing the portion of the light beam not blocked by said plate and providing a signal indicative of a misfeed into said pocket, said signal being provided in response to said plate moving said predetermined amount to block the second portion of the light beam.

22. An apparatus as set forth in claim 21 wherein the first portion of the light beam is smaller than the second portion of the light beam. about its longitudinal central axis in response to displacement of said displaceable roller, the extent of movement of said plate being associated with the extent of rotation of said shaft about its longitudinal central axis.

23. An apparatus comprising:

a plurality of hoppers for holding signatures;

a collating pocket movable past said plurality of hoppers and for receiving a signature from each of said plurality of hoppers;

a member connected with said collating pocket and for moving relative to said pocket in response to a feed of a signature into said pocket, said member remaining stationary relative to said pocket in response to a misfeed into said pocket;

sensor means for sensing that said member remained stationary in response to a misfeed into said pocket and for providing a signal indicative thereof; and a light source for providing a light beam, said plate moving to block a first portion of the light beam when a signature is received in said pocket, said plate remaining stationary relative to said pocket and blocking a second portion of the light beam when a misfeed into said pocket occurs, said sensor means sensing the portion of the light beam not blocked by said plate and providing a signal indicative of a misfeed into said pocket, said signal being provided in response to said plate remaining stationary relative to said pocket and blocking the second portion of the light beam.

24. An apparatus as set forth in claim 23 wherein the first portion oft he light beam is larger than the second portion of the light beam.

* * * * *

UNITED STATES PATENT AND TRADEMARK OFFICE

CERTIFICATE OF CORRECTION

PATENT NO. : 5,213,318

DATED : May 25, 1993

INVENTOR(S) : Thomas O. Newhall

It is certified that error appears in the above-identified patent and that said Letters Patent is hereby corrected as shown below:

Column 8, lines 43-44, change "ex-tend" to -- extent --.

Column 8, line 58, change "foth" to -- forth --.

Column 10, line 40, change "bean" to -- beam --.

Column 10, line 54, delete "about its longitudinal central".

Column 10, lines 55-58, delete "axis in response to displacement of said displaceable roller, the extent of movement of said plate being associated with the extent of rotation of said shaft about its longitudinal central axis."

Column 12, line 8, change "oft he" to -- of the --.

Signed and Sealed this

Twenty-eighth Day of December, 1993

*Attest:*

Bruce Lehman

BRUCE LEHMAN

*Attesting Officer*

*Commissioner of Patents and Trademarks*